US005211587A

United States Patent [19]

Alden

[11] Patent Number: 5,211,587

[45] Date of Patent: May 18, 1993

[54] HIGH VOLTAGE CONNECTOR WITH CORONA SHIELD

[75] Inventor: Peter H. Alden, North Easton, Mass.

[73] Assignee: Alden Proucts Company, Brockton, Mass.

[21] Appl. No.: 933,496

[22] Filed: Aug. 20, 1992

[51] Int. Cl.[5] ..... H01R 13/00

[52] U.S. Cl. ..... 439/843; 439/852

[58] Field of Search ..... 439/816, 842-844, 439/851-855, 856, 857, 861, 862

[56] References Cited

U.S. PATENT DOCUMENTS

| | | | |
|---|---|---|---|
| 1,194,122 | 8/1918 | Ball | 439/852 |
| 2,968,787 | 1/1961 | Wootton | 439/843 |
| 3,426,320 | 2/1969 | Wilm | 439/852 |
| 4,148,547 | 4/1979 | Otsuki et al. | 439/843 |

*Primary Examiner*—Joseph H. McGlynn
*Attorney, Agent, or Firm*—James H. Grover

[57] ABSTRACT

A socket for a high voltage plug is folded from a single sheet of metal to form a cylindrical corona shield on an axis about a pair of spring contacts. The shield and contacts extend from a cylindrical base of the shield along a solder face to an outer segmental lip for suppressing corona from wiring on the face.

16 Claims, 1 Drawing Sheet

HIGH VOLTAGE CONNECTOR WITH CORONA SHIELD

BACKGROUND OF THE INVENTION

An electrical connector attached to a high voltage terminal of an electron power tube or a flash tube will carry from 500 to 50000 volts or more and is heavily insulated in a housing of a plastic material such as high density polyethylene or other polymeric insulation. The high applied voltage inevitably produces emission of corona from the connector which causes chemical and structural deterioration of the plastic. It is therefor highly desirable to provide some kind of corona shielding between the metal of the connector and its insulating housing.

It is the object of the present invention to provide an improved high voltage connector with more complete corona shielding than previously, and in a connector more economically produced.

SUMMARY OF THE INVENTION

According to the invention a high voltage connector for receiving a cylindrical contactor along an axis comprises a single sheet of metal having a circular base on the axis, a rectangular face extending outwardly from the base parallel to the axis, two arcuate extensions from the face forming a cylindrical enclosure concentric with the axis, and the extensions having a reentrant ends forming with the face an inner three sided spring socket open at one end to receive the cylindrical contactor, so that an integral connector socket with a surrounding corona shield are formed integrally from one sheet of metal. Preferably the rectangular face provides a wiring terminal inside the cylindrical volume of the arcuate extensions, and the face includes a segmental lip folded in from its outer end.

In a further aspect the connector is formed by cutting a sheet of metal to form a circular base with a rectangular face and two wings extending laterally from the face; folding the face at right angles to the base; folding the wings to form a socket with base; and further folding the wings to form an integral cylindrical corona shield around the socket so as to afford economical manufacture by progressive die stampings.

DRAWINGS

DESCRIPTION

Figure 1:
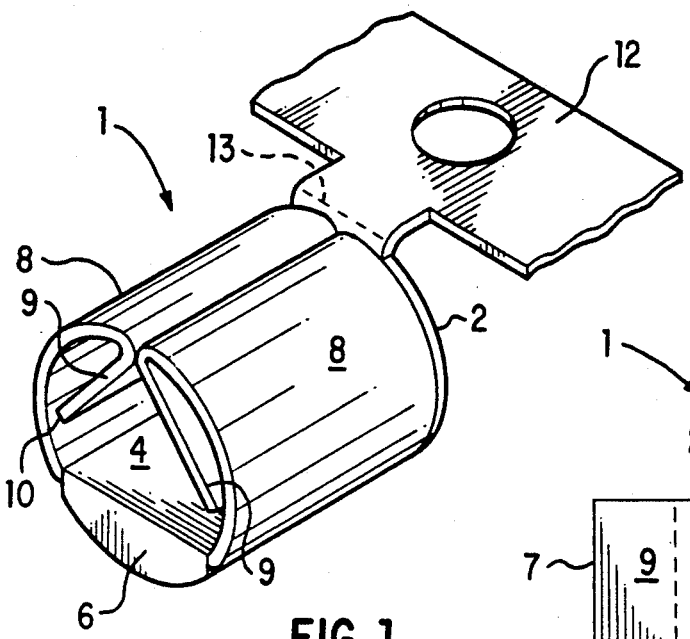
FIG 1 is an isometric view of the connector according to the invention.
Figure 4:
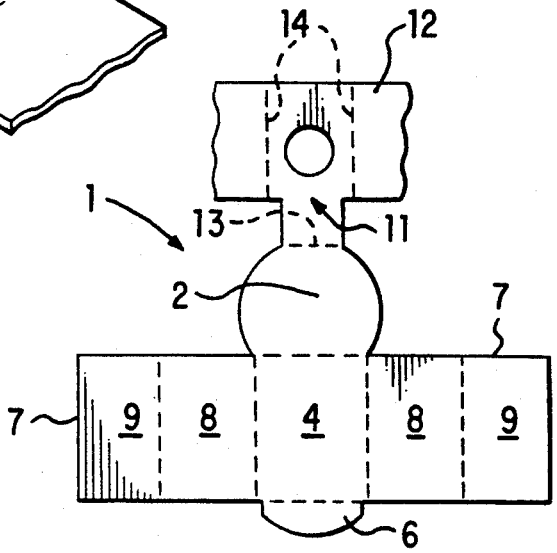
FIG. 4 is a plan view of a metal sheet cut to form the connector of FIGS. 1 to 3.
Figure 2:
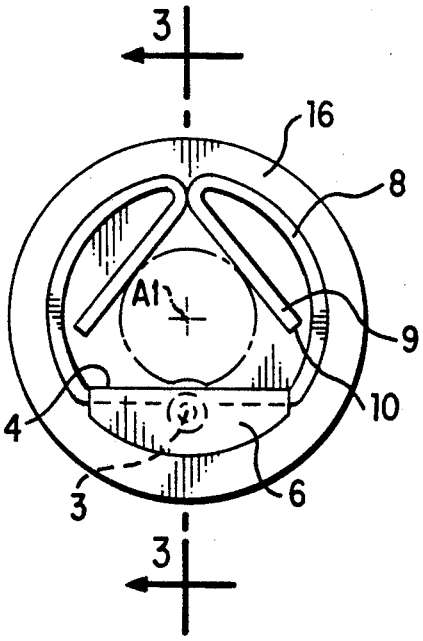
FIG. 2 is an end elevation of the connector of FIG. 1 housed in insulation.
Figure 3:
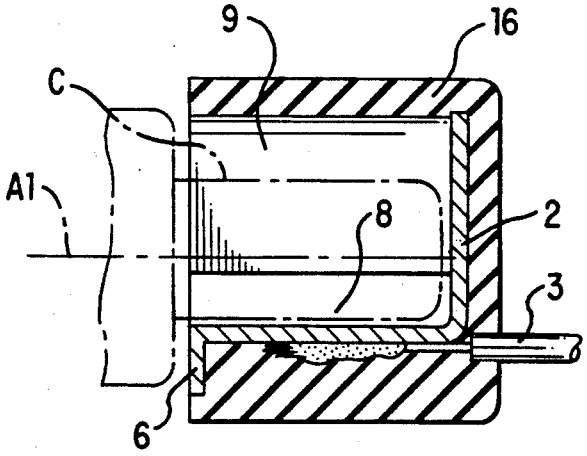
FIG. 3 is a section on line 3—3 of FIG. 2.

As shown in FIGS. 1 to 4 the connector of the present is formed by initially cutting a blank of plane sheet of metal 1 to the shape of FIG. 4, then folding the sheet to the three dimensional form 1* of FIG. 1, and later enclosing it in an insulating housing 16 shown in FIGS. 3 and 4 after soldering or otherwise electrically connecting an insulated wire 3 to the connector in condition to receive a plug or similar cylindrical contactor C.

The blank of sheet metal 1 in FIG. 4 is cut with a circular base 2 with an axis Al from which a rectangular face 3 extends parallel to the axis to a circularly segmental lip 6. Two wings 7 extend laterally of the face , each wing including a shield portion 8 and an end portion 9 with a tip 10. Opposite the face 4 a tab 11 is connected to a continuous feed strip 12 holding a number of blanks. Single connector sheets 1 may be severed from the feed strip either at a first cut line 13, in which case the rectangular face 4 comprises a solder terminal for the wire 3, or at second cut lines 14, in which case the tab 13 provides a terminal for soldering, crimping or welding the wire 3.

Preferably the connector sheets are not separated from the feed strip until after wires are connected automatically to the face 4 or the tab 11. The structure of the connector is such that the arcuate extensions 8 and portions 9 are accessible at the outward end of the face 4 for folding to the form shown in FIG. 1 by progressive die forming operations.

Before being separated from the feed strip each connector is formed to the three-dimensional shape of FIG. 1 by folding rectangular face 4 at right angles to the circular base 2. The shield portions 8 are folded to form a cylindrical enclosure concentric with the axis Al of the base 2, and the end portions 9 of the wings 7 are reentrantly folded to form inside the enclosure a three sided spring socket including the face 4. The structure of the connector is such that the arcuate extensions 8 and the end portions 9 are accessible at the outward end of the face for folding to the form shown in FIG. 1 by the progressive die forming operations described. The sheet is of a flexible metal so that the reentrant ends flexibly receive the plug C, as shown in FIGS. 2 and 3, and the shield portions 8 forming the cylindrical enclosure are spaced outwardly of the tips 10 of the reentrant ends 9 to allow them to flex freely even when the connector is confined in the insulating housing 16 molded around the connector to its open end which receives the contactor C. The shielding cylindrical enclosure materially supresses corona emission from the reentrant ends by virtue of the electric stress reducing geometry of the connector, particularly the base 2, the face 4 and circularly segmental lip 6 which with the arcuate extensions 8 enclose and shield the reentrant spring ends 9 receiving the cylindrical contactor C.

When the rectangular face serves an a solder terminal for a wire 3, as shown in FIGS. 2 and 3 the end of the wire usually presents pointed ends promoting a corona inception point which can lead to decomposition of the plastic insulation 16 around the connector to its open end. To further confine and reduce corona deterioration, the lip 6 is folded over the insulation at the outer end of the socket so as to mask the wire ends.

The connector thus provides a corona shielding base 2 and cylindrical enclosure 8 about spring contacts 9 and a wiring face 4 all formed from a single sheet of metal also including a shielding lip for a surrounding insulating housing.

It should be understood that the present disclosure is for the purpose of illustration only, and that the invention includes all modifications and equivalents falling within the appended claims.

I claim:

1. A high voltage connector for receiving a cylindrical contactor along a connector axis comprising:

a single sheet of metal having a circular base on the axis;

a rectangular face extending outwardly from the base parallel to the axis; and two arcuate extensions from &he face forming a cylindrical enclosure concentric with the axis;

the extensions each having a reentrant end forming with the face an inner three sided spring socket open at one end to receive the cylindrical contactor;

so that an integral connector socket and a surrounding corona shield are formed integrally from one sheet of metal.

2. A connector according to claim 1 wherein the extensions are accessible at the outward end of the face for folding by progressive die forming operations.

3. A connector according to claim 1 including a circularly segmental lip concentric with and at a right angle to the axis, and folded from the outer end of the face.

4. A connector according to claim 1 including a housing of insulating material sealing the cylindrical enclosure.

5. A connector according to claim 1 wherein the sheet is a resilient metal such that the reentrant ends flexibly receive the contactor.

6. A connector according to claim 5 wherein the reentrant ends are free to flex without expanding the cylindrical enclosure.

7. A connector according to claim 1 wherein the rectangular face provides a wiring terminal inside the cylindrical volume defined by the arcuate extensions.

8. A connector according to claim 7 including a circularly segmental lip concentric with, and at a right angle to, the connector axis, and folded from the outer end of the face so as to shield the cylindrical volume at the solder terminal.

9. A sheet of metal for forming a plurality of connectors according to claim 1 in which each connector has a tab extending from the circular base, the tabs being connected in a continuous strip.

10. The method of forming the connector of claim 9 wherein an electrical connection is made to each tab, and the tab is thereafter separated from the continuous strip.

11. A connector according to claim 9 wherein each tab comprises a wiring terminal.

12. A connector according to claim 11 wherein the tab accomodates electrical termination and is separable from the strip.

13. A connector according to claim 1 wherein the cylindrical enclosure is spaced outwardly of the reentrant end allowing them to flex freely.

14. A connector according to claim 13 including a housing of insulating material sealing the cylindrical enclosure.

15. The method of forming the connector of claim 1 which comprises:

cutting a sheet of metal to form a circular base, a rectangular face extending from the base, and two wings extending laterally of the face;

folding the face at right angles to the base;

folding each wing intermediate its ends to form with the face a spring socket; and further folding the wings arcuately to form a cylindrical shield around the socket.

16. The method of claim 15 wherein a circularly segmental lip is formed at the outer end of the rectangular face, and is folded at right angles to the face concentrically with the cylindrical shield.

* * * * *